US011473519B2

(12) United States Patent
Kitao

(10) Patent No.: US 11,473,519 B2
(45) Date of Patent: Oct. 18, 2022

(54) INTERNAL COMBUSTION ENGINE CONTROL APPARATUS

(71) Applicant: Mitsubishi Electric Corporation, Tokyo (JP)

(72) Inventor: Takeshi Kitao, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/397,227

(22) Filed: Aug. 9, 2021

(65) Prior Publication Data

US 2022/0298986 A1 Sep. 22, 2022

(30) Foreign Application Priority Data

Mar. 18, 2021 (JP) ..... JP2021-044795

(51) Int. Cl.
*F02D 41/14* (2006.01)
*F02D 41/28* (2006.01)

(52) U.S. Cl.
CPC ..... *F02D 41/1497* (2013.01); *F02D 41/28* (2013.01); *F02D 2041/288* (2013.01)

(58) Field of Classification Search
CPC . F02D 41/1497; F02D 41/28; F02D 2041/288
See application file for complete search history.

(56) References Cited

U.S. PATENT DOCUMENTS

| | | | | |
|---|---|---|---|---|
| 11,008,996 | B2 * | 5/2021 | Mori | G01L 23/221 |
| 2015/0211430 | A1 * | 7/2015 | Remele | F02D 41/009 123/480 |
| 2019/0085324 | A1 * | 3/2019 | Regev | C12N 15/113 |
| 2020/0152289 | A1 * | 5/2020 | Cleary | C12Q 1/6874 |
| 2021/0088020 | A1 * | 3/2021 | Mori | F02P 5/152 |

FOREIGN PATENT DOCUMENTS

| | | | |
|---|---|---|---|
| CN | 102928514 | B * | 12/2014 |
| JP | H06-272607 | A | 9/1994 |
| JP | 6-331501 | A | 12/1994 |
| JP | 2004-52614 | A | 2/2004 |
| JP | 2017-151228 | A | 8/2017 |

OTHER PUBLICATIONS

Office Action dated Jun. 7, 2022 in Japanese Application No. 2021-044795.

* cited by examiner

*Primary Examiner* — Joseph J Dallo
(74) *Attorney, Agent, or Firm* — Sughrue Mion, PLLC; Richard C. Turner

(57) ABSTRACT

In an internal combustion engine control apparatus, an electronic control device is configured to subject a signal from a knock sensor to short-time Fourier transform, to thereby generate an observation matrix. Further, the electronic control device is configured to decompose the observation matrix into knocking vibration data being data on vibration caused by knocking and mechanical vibration data being data on vibration other than the knocking.

7 Claims, 6 Drawing Sheets

INTERNAL COMBUSTION ENGINE CONTROL APPARATUS

BACKGROUND OF THE INVENTION

1. Field of the Invention

This disclosure relates to an internal combustion engine control apparatus.

2. Description of the Related Art

In a related-art knock control apparatus, a knock analysis section is changed based on an opening/closing timing of at least one of an intake value or an exhaust value of an internal combustion engine, and frequency analysis is performed (refer to, for example, Japanese Patent Application Laid-open No. 2004-52614).

In the related-art knock control apparatus described above, when the opening/closing timing of the intake value and the exhaust value and a timing at which knocking occurs overlaps with each other, the knocking cannot be detected.

SUMMARY OF THE INVENTION

This disclosure has been made in order to solve the above-mentioned problem, and has an object to provide an internal combustion engine control apparatus capable of more accurately detecting knocking.

According to at least one embodiment of this disclosure, there is provided an internal combustion engine control apparatus including an electronic control device to which a signal from a knock sensor configured to detect vibration of an internal combustion engine is to be input, the electronic control device being configured to: subject the signal from the knock sensor to short-time Fourier transform, to thereby generate an observation matrix; and subject a noise basis matrix obtained by subjecting a signal from the knock sensor in a state in which mechanical vibration other than knocking occurs to non-negative matrix factorization and the observation matrix to semi-supervised non-negative matrix factorization, to thereby decompose the observation matrix into knocking vibration data being data on vibration caused by knocking and mechanical vibration data being data on vibration other than the knocking.

The internal combustion engine control apparatus of this disclosure is capable of more accurately detecting knocking.

DESCRIPTION OF THE EMBODIMENTS

Now, embodiments of this disclosure are described with reference to the drawings.

First Embodiment

Figure 1:
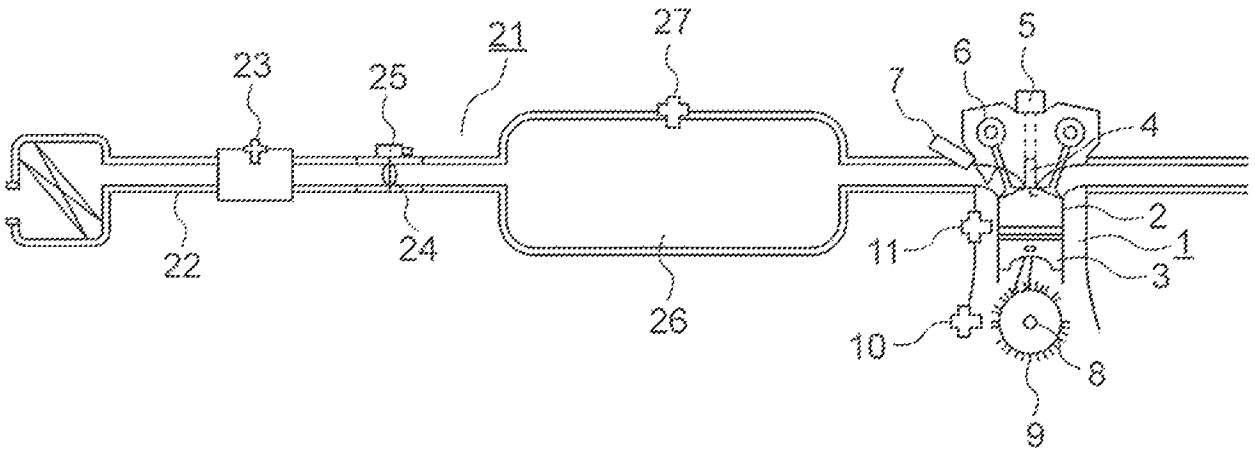
FIG. 1 is a schematic configuration diagram for illustrating an internal combustion engine and an intake system in a first embodiment of this disclosure.

FIG. 1 is a schematic configuration diagram for illustrating an internal combustion engine and an intake system in a first embodiment of this disclosure. An internal combustion engine 1 includes a cylinder 2, a piston 3, an ignition plug 4, an ignition coil 5, a variable intake valve mechanism 6, an injector 7, a crankshaft 8, a detection plate 9, a crank angle sensor 10, and a knock sensor 11.

The piston 3 is provided in the cylinder 2. The ignition plug 4 is provided to the cylinder 2. The ignition plug 4 is configured to ignite an air-fuel mixture contained in the cylinder 2. The ignition coil 5 is connected to the ignition plug 4. The ignition coil 5 is configured to generate a high voltage to be used by the ignition plug 4 to discharge electricity.

The variable intake valve mechanism 6 includes an intake valve. The intake valve is configured to open and close an intake port of the cylinder 2. In the variable intake valve mechanism 6, an opening/closing timing of the intake valve or a lift amount of the intake valve is controllable.

The injector 7 is provided to the intake port of the cylinder 2. The injector 7 is configured to inject fuel to the intake port. The injector 7 may be arranged so that the injector 7 can directly inject fuel into the cylinder 2.

The piston 3 is coupled to the crankshaft 8 through the intermediation of a crank. The crankshaft 8 is configured to rotate through a reciprocating motion of the piston 3. The detection plate 9 is fixed to the crankshaft 8. This enables the detection plate 9 to rotate integrally with the crankshaft 8.

The crank angle sensor 10 is configured to detect an edge of the detection plate 9. The knock sensor 11 is configured to detect vibration of the internal combustion engine 1.

An intake system 21 includes an intake pipe 22, an air flow sensor 23, an electronically controlled throttle valve 24, an opening degree sensor 25, a surge tank 26, and an intake manifold pressure sensor 27.

An end of the intake pipe 22 on a downstream side is connected to the intake port of the cylinder 2. The air flow sensor 23 is provided on the intake pipe 22. The air flow sensor 23 is configured to detect a flow rate of intake air.

The electronically controlled throttle valve 24 is provided in the intake pipe 22 on the internal combustion engine 1 side with respect to the air flow sensor 23. An opening degree of the electronically controlled throttle valve 24 is electronically controlled in order to adjust the flow rate of intake air. The opening degree sensor 25 is configured to detect the opening degree of the electronically controlled throttle valve 24.

In place of the electronically controlled throttle valve 24, a mechanical throttle valve (not shown) may be used. The mechanical throttle valve is connected to an accelerator pedal (not shown) through the intermediation of a wire.

The surge tank 26 is provided in the intake pipe 22 on the internal combustion engine 1 side with respect to the electronically controlled throttle valve 24. The surge tank 26 is configured to level increase and decrease of a flow rate of air. The intake manifold pressure sensor 27 is configured to detect a pressure inside the surge tank 26.

One of the air flow sensor 23 or the intake manifold pressure sensor 27 may be omitted.

Figure 2:
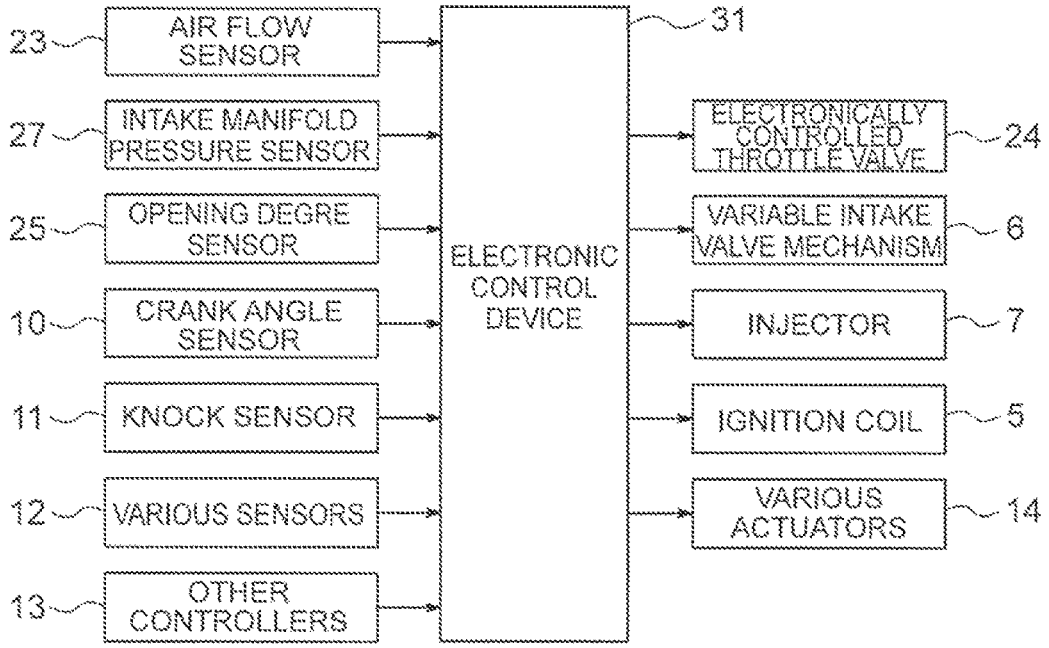
FIG. 2 is a block diagram for illustrating a control system for the internal combustion engine of FIG. 1.

FIG. 2 is a block diagram for illustrating a control system for the internal combustion engine 1 of FIG. 1. An internal combustion engine control apparatus configured to control the internal combustion engine 1 and the intake system 21 includes an electronic control device 31.

To the electronic control device 31, a signal from the crank angle sensor 10, a signal from the knock sensor 11, a signal from the air flow sensor 23, a signal from the opening degree sensor 25, and a signal from the intake manifold pressure sensor 27 are input.

Signals from various sensors 12 other than the above-mentioned sensors and signals from other controllers 13 are also input to the electronic control device 31.

The electronic control device 31 is configured to control the ignition coil 5, the variable intake valve mechanism 6, the injector 7, and the electronically controlled throttle valve 24. The electronic control device 31 is also configured to control various actuators 14 other than the above-mentioned components.

Figure 3:
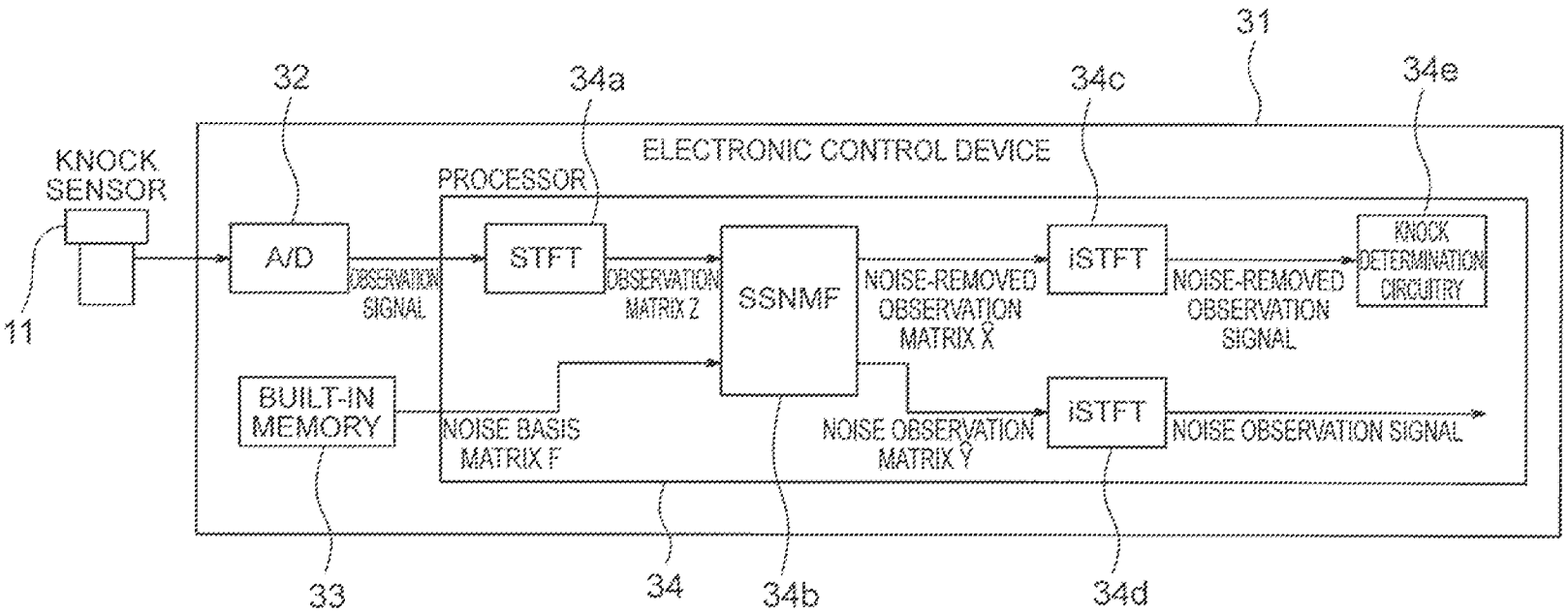
FIG. 3 is a block diagram for illustrating a main part of an electronic control device of FIG. 2.

FIG. 3 is a block diagram for illustrating a main part of the electronic control device 31 of FIG. 2. In FIG. 3, only a part of the electronic control device 31 that is relevant to knock determination processing is illustrated.

The electronic control device 31 includes an A/D convertor 32, a built-in memory 33, and a processor 34. The signal from the knock sensor 11 is input to the A/D convertor 32 to be subjected to A/D conversion.

In the built-in memory 33, a noise basis matrix F having "m" rows and "k" columns is stored. The noise basis matrix F is acquired in advance through learning.

Further, the noise basis matrix F is data obtained by subjecting a signal from the knock sensor 11 in a state in which mechanical vibration other than knocking occurs to non-negative matrix factorization. In other words, the noise basis matrix F is data derived by subjecting an observation value obtained by the knock sensor 11 at an ignition timing at which knocking does not occur to non-negative matrix factorization as data in which only mechanical noise exist.

The processor 34 includes, as its functional blocks, short-time Fourier transform (STFT) processing circuitry 34*a*, semi-supervised non-negative matrix factorization (SSNMF) processing circuitry 34*b* serving as extraction circuitry, first inverse short-time Fourier transform (iSTFT) processing circuitry 34*c*, second iSTFT processing circuitry 34*d*, and knock determination circuitry 34*e*.

The STFT processing circuitry 34*a* is configured to subject the observation signal from the A/D convertor 32 to STFT, that is, short-time Fourier transform. With this processing, the STFT processing circuitry 34*a* generates an observation matrix Z having "m" rows and "n" columns and indicating a frequency-time spectrum characteristic, that is, a frequency spectrum characteristic of acoustic data. The observation matrix Z is input to the SSNMF processing circuitry 34*b*.

The "n" columns in a time direction which correspond to the columns of the observation matrix Z are extracted through STFT processing every specific time "t". It should be noted, however, that as the timing to extract the "n" columns, the "n" columns may also be extracted at every specific crank angle of the internal combustion engine 1. The specific crank angle is, for example, from 20° crank angle (CA) before top dead center (BTDC) to 80° CA after top dead center (ATDC).

The SSNMF processing circuitry 34*b* is configured to read out the noise basis matrix F from the built-in memory 33. The SSNMF processing circuitry 34*b* is also configured to subject the noise basis matrix F and the observation matrix Z to SSNMF, that is, semi-supervised non-negative matrix factorization. With this processing, the SSNMF processing circuitry 34*b* decomposes the observation matrix Z into knocking vibration data being data on vibration caused by knocking and mechanical vibration data being data on vibration caused by vibration other than the knocking.

Specifically, the SSNMF processing circuitry 34*b* updates a knock basis matrix H, a knock activation matrix U, and a noise activation matrix G through use of the following expressions. There are various expressions as expressions for updating the matrices, but the expressions given below are expressions for updating the matrices which are based on Euclidean divergence.

$$H_{m,k} = H_{m,k}\frac{Z_{m,n}\cdot U_{k,n}^T}{(H_{m,k}\cdot U_{k,n} + F_{m,k}\cdot G_{k,n})\cdot U_{k,n}^T}$$

$$U_{k,n} = U_{k,n}\frac{H_{m,k}^T\cdot Z_{m,n}}{H_{m,k}^T\cdot(H_{m,k}\cdot U_{k,n} + F_{m,k}\cdot G_{k,n})}$$

$$G_{k,n} = G_{k,n}\frac{F_{m,k}^T\cdot Z_{m,n}}{F_{m,k}^T\cdot(H_{m,k}\cdot U_{k,n} + F_{m,k}\cdot G_{k,n})}$$

The symbol "•" in the expressions represents an inner product of matrices. The updating of the values in the expressions is performed in order from the top of the expressions. The knock basis matrix H has "m" rows and "k" columns, and the knock activation matrix U and the noise activation matrix G each have "k" rows and "n" columns. The matrix with a superscript of "T" is a transposed matrix.

The updating of the values using the expressions given above may be repeated the number of times determined in advance, or an error function, for example, the following expression, may be defined, and the updating of the values may be repeated until an error becomes smaller than a set error.

$$D_{Euclid}(Z|(H\cdot U+F\cdot G))=(Z-(H\cdot U+F\cdot G))^2$$

The relationships given above are established because a frequency spectrum of acoustic data is formed by a combination of frequency spectra of various sounds. When the observation matrix is represented by Z, an expression for expressing a characteristic of the observation matrix by a combination of a matrix X and a matrix Y is the following expression.

$$Z=X+Y$$

In this description, X is set as a noise-removed observation matrix, and Y is set as a noise observation matrix. Further, the frequency spectrum of acoustic data itself can also be decomposed into a basis matrix and an activation matrix based on the idea of non-negative matrix factorization (NMF).

The noise-removed observation matrix X being the knocking vibration data and the noise observation matrix Y being the mechanical vibration data can be expressed by respective expressions given below.

$$X_{m,n}=H_{m,k}\cdot U_{k,n}=\hat{X}_{m,n}$$

$$Y_{m,n}=F_{m,k}\cdot G_{k,n}=\hat{Y}_{m,n}$$

The knock basis matrix H and the knock activation matrix U are used, and an inner product thereof is calculated as in the expressions given above. As a result, a noise-removed observation matrix $\hat{X}$ is generated. In this case, the noise-removed observation matrix is represented not as "X" but as "$\hat{X}$" because a slight error remains in the noise-removed observation matrix as compared with the matrix X which is a true noise-removed observation matrix. Strictly, the noise-removed observation matrix contains a slight error, but it can also be regarded that strictness of such a degree is not always required.

The first iSTFT processing circuitry 34*c* is configured to subject the noise-removed observation matrix to iSTFT, that is, inverse short-time Fourier transform. With this processing, the first iSTFT processing circuitry 34*c* generates a noise-removed observation signal. The noise-removed observation signal is input to the knock determination circuitry 34*e*.

The second iSTFT processing circuitry 34*d* is configured to subject the noise observation matrix to inverse short-time Fourier transform. With this processing, the second iSTFT processing circuitry 34*d* obtains a noise observation signal.

The knock determination circuitry 34*e* is configured to perform determination relating to knocking based on the noise-removed observation signal being the knocking vibration data. The determination relating to knocking includes, for example, determination of the strength of knocking and determination of whether or not excessive knocking occurs.

A knock determination threshold value is set in the knock determination circuitry 34*e*. The knock determination threshold value is a threshold value to be used as a reference in the determination of whether or not excessive knocking occurs. The knock determination circuitry 34*e* determines that excessive knocking occurs when the level of knocking vibration is larger than the knock determination threshold value.

The electronic control device 31 outputs to the outside a command corresponding to a determination result obtained by the knock determination circuitry 34*e*, for example, an ignition timing retard angle control command.

Figure 4:
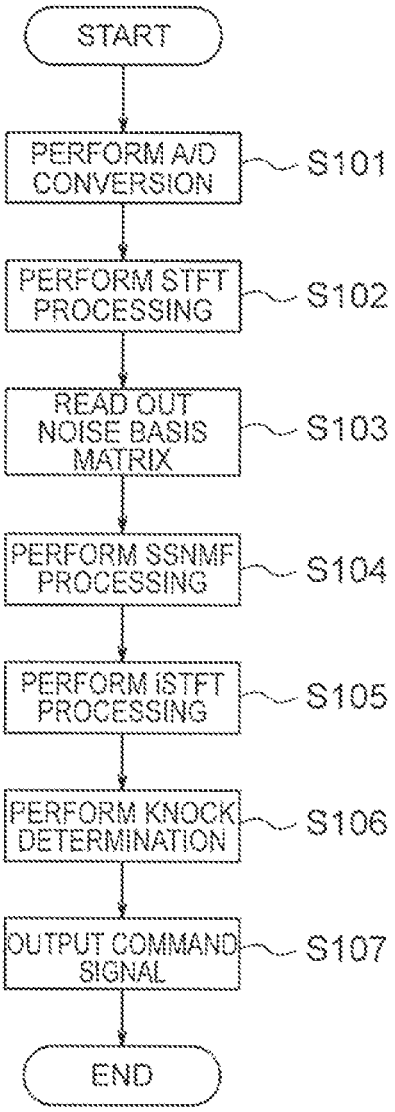
FIG. 4 is flowchart for illustrating knock determination processing to be performed by the electronic control device of FIG. 3.

FIG. 4 is flowchart for illustrating the knock determination processing to be performed by the electronic control device 31 of FIG. 3. The electronic control device 31 periodically and repeatedly executes the knock determination processing of FIG. 3.

In Step S101, the electronic control device 31 subjects the signal from the knock sensor 11 to A/D conversion to generate the observation signal. Subsequently, in Step S102, the electronic control device 31 subjects the observation signal to short-time Fourier transform to generate the observation matrix.

After that, in Step S103, the electronic control device 31 reads out the noise basis matrix from the built-in memory 33. Then, in Step S104, the electronic control device 31 subjects the noise basis matrix and the observation matrix to semi-supervised non-negative matrix factorization, to thereby decompose the observation matrix into the noise-removed observation matrix and the noise observation matrix.

Next, in Step S105, the electronic control device 31 subjects each of the noise-removed observation matrix and the noise observation matrix to inverse short-time Fourier transform, to thereby generate the noise-removed observation signal and the noise observation signal.

After that, in Step S106, the electronic control device 31 performs determination relating to knocking based on the noise-removed observation signal. Then, in Step S107, the electronic control device 31 outputs a command signal corresponding to a determination result to the outside, and ends the processing.

In the internal combustion engine control apparatus described above, the signal from the knock sensor 11 is subjected to short-time Fourier transform, to thereby generate the observation matrix. Further, the noise basis matrix and the observation matrix are subjected to the semi-supervised non-negative matrix factorization so that the observation matrix is decomposed into the noise-removed observation matrix and the noise observation matrix.

As a result, mechanical noise can be removed from an input signal at a stage prior to the knock determination. This enables knocking to be detected more accurately with a simple configuration without requiring complicated control. Therefore, without impairing an ability to detect knocking caused by abnormal combustion, it is possible to prevent erroneous knock determination caused by mechanical vibration other than knocking.

In the first embodiment, the noise basis matrix is stored in the built-in memory 33 after being learned in advance under an operating state without knocking. However, the noise basis matrix may be updated by being learned as required under the operating state without knocking. In this case, with the method of non-negative matrix factorization, an observation matrix Z' obtained under the state without knocking is decomposed into a basis matrix and an activation matrix, and the basis matrix is set as a basis matrix of a mechanical noise frequency pattern, that is, the noise basis matrix F.

Second Embodiment

Figure 5:
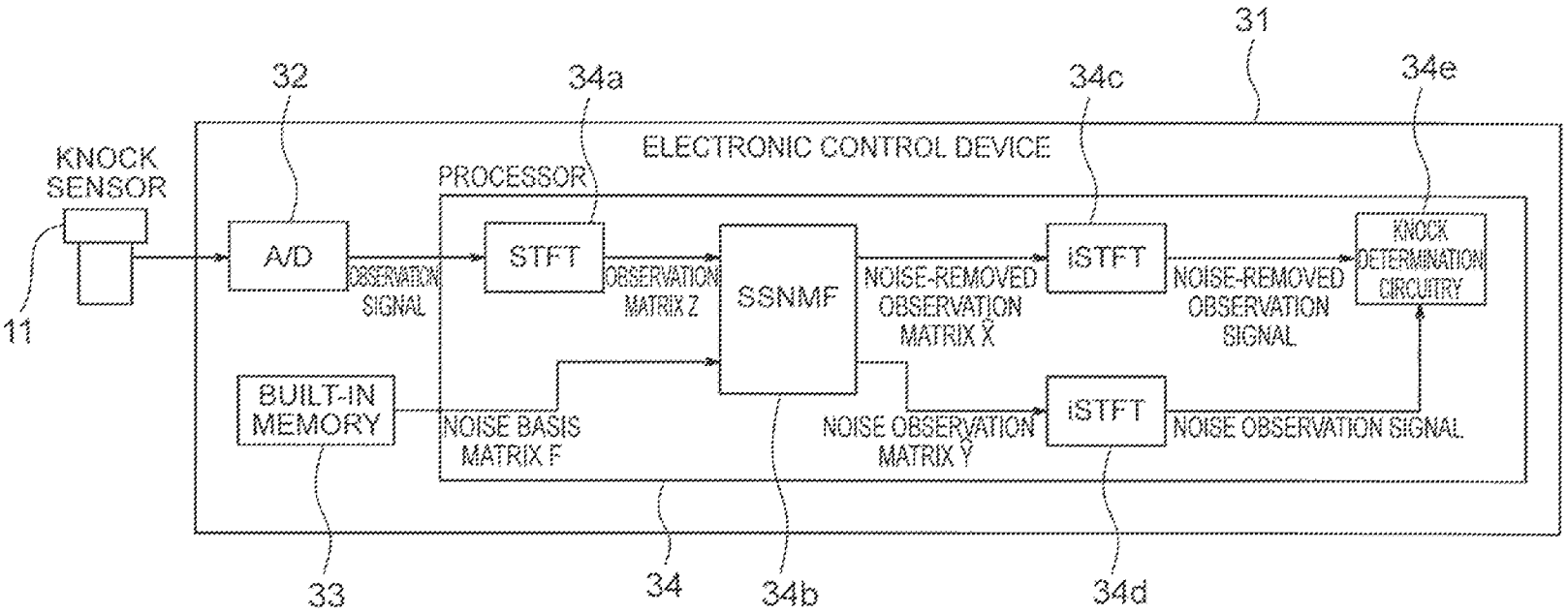
FIG. 5 is a block diagram for illustrating a main part of an electronic control device in a second embodiment of this disclosure.

Next, FIG. 5 is a block diagram for illustrating a main part of an electronic control device 31 in a second embodiment of this disclosure. Knock determination circuitry 34*e* in the second embodiment is configured to correct a determination result relating to knocking based on the noise observation signal from the second iSTFT processing circuitry 34*d*.

For example, the knock determination circuitry 34*e* changes the knock determination threshold value based on the noise observation signal.

Specifically, when a vibration level in the noise observation signal, that is, a noise level is high, the knock determination circuitry 34*e* sets the knock determination threshold value to a larger value than when the noise level is low. In the knock determination circuitry 34*e*, one noise threshold value or two or more noise threshold values to be used as a reference in comparison with the noise level are set.

Further, when the noise level is larger than the noise threshold value, the knock determination circuitry 34*e* may disable the determination result.

Further, the knock determination circuitry 34*e* does not correct the determination result under a state in which learning of the noise basis matrix is unfinished.

Figure 6:
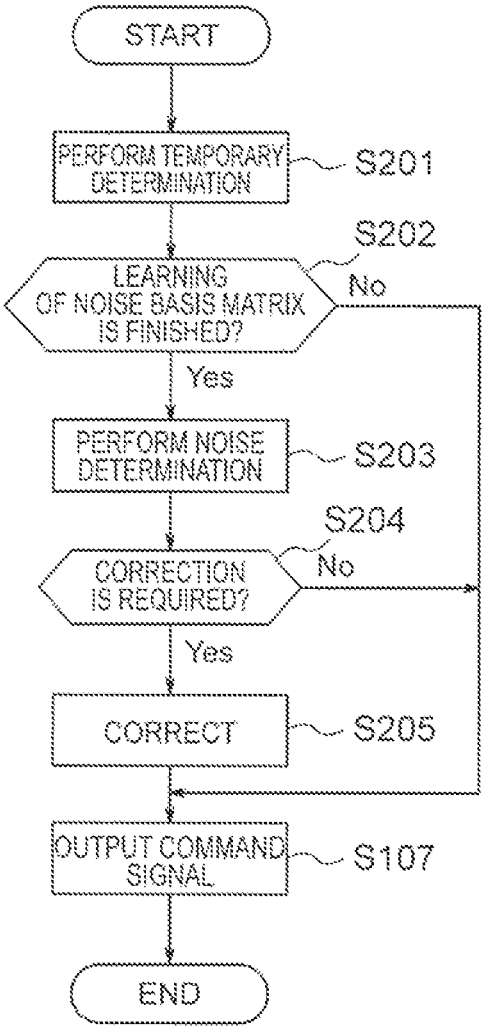
FIG. 6 is flowchart for illustrating an operation of knock determination circuitry of FIG. 5.

FIG. 6 is flowchart for illustrating an operation of the knock determination circuitry 34*e* of FIG. 5. In Step S201, the knock determination circuitry 34*e* performs temporary determination relating to knocking based on the noise-removed observation signal. This processing of the temporary determination is similar to the processing performed in Step S106 of FIG. 4.

Subsequently, in Step S202, the knock determination circuitry 34*e* examines whether or not learning of the noise basis matrix is finished. When the learning is not finished, the knock determination circuitry 34*e* sets a result of temporary determination as a determination result relating to knocking as it is. Then, in the same manner as in the first embodiment, in Step S107, the knock determination circuitry 34*e* outputs a command signal corresponding to the determination result to the outside, and ends the processing.

When the learning of the noise basis matrix is finished, in Step S203, the knock determination circuitry 34*e* performs noise determination. Specifically, the knock determination circuitry 34*e* compares the noise level with the noise threshold value.

After that, in Step S204, the knock determination circuitry 34*e* determines, based on a result of the noise determination, whether or not it is required to correct the result of temporary determination. When it is not required to correct the result of temporary determination, the knock determination circuitry 34*e* sets the result of temporary determination as the determination result relating to knocking as it is. Then, in Step S107, the knock determination circuitry 34*e* outputs the command signal corresponding to the determination result to the outside, and ends the processing.

When it is required to correct the result of temporary determination, in Step S205, the knock determination circuitry 34*e* corrects the result of temporary determination, and sets the corrected determination result as the determination result relating to knocking. Then, in Step S107, the knock determination circuitry 34*e* outputs the command signal corresponding to the determination result to the outside, and ends the processing.

Except for the configuration of the electronic control device 31 illustrated in FIG. 5 and the operation of the knock determination circuitry 34*e* illustrated in FIG. 6, the configuration and operation of the internal combustion engine control apparatus are the same as those of the first embodiment.

In the internal combustion engine control apparatus described above, the determination result relating to knocking is corrected based on the noise observation signal. As a result, it is possible to detect knocking more accurately. For example, even when it is temporarily determined that knocking of a higher level than an actual level occurs because the noise level is high, the result of temporary determination is corrected, and it is thus possible to obtain a determination result that is close to an actual state of knocking.

With this configuration, for example, it is possible to prevent a retard angle control amount of ignition timing retard angle control from increasing more than required, and it is thus possible to prevent decrease in performance of the internal combustion engine 1 caused by excessive control.

Further, under the state in which the learning of the noise basis matrix is unfinished, the knock determination circuitry 34*e* does not correct the determination result. As a result, it is possible to prevent erroneous noise determination from being performed owing to unfinished learning data.

Further, the knock determination circuitry 34*e* changes the knock determination threshold value based on the noise observation signal. As a result, it is possible to correct the determination result through simple processing.

Further, when the noise level is high, the knock determination circuitry 34*e* sets the knock determination threshold value to a larger value than when the noise level is low. As a result, it is possible to prevent erroneous knocking determination caused by a high noise level.

For example, with the expectation of a state in which the noise level is low, the knock determination threshold value is set to a small value, and when the noise level is larger than the noise threshold value, the knock determination threshold value is set to a large value. As a result, it is possible to prevent erroneous detection while keeping the ability to detect knocking at normal times at a high level, and it is thus possible to reduce a risk of damage to the internal combustion engine 1 caused by a failure to detect knocking.

In the second embodiment, the noise-removed observation signal and the noise observation signal are obtained from the observation signal by a method similar to that of the first embodiment. However, in the second embodiment, the method of extracting the knocking vibration data and the mechanical vibration data from the signal of the knock sensor 11 is not particularly limited to any method.

Further, in the second embodiment, the method of correcting the determination result relating to knocking is not limited to changing the knock determination threshold value. For example, the level itself of the noise observation signal may be corrected.

REFERENCE SIGNS LIST

1 internal combustion engine, 11 knock sensor, 31 electronic control device, 34*b* SSNMF processing circuitry (extraction circuitry), 34*e* knock determination circuitry

What is claimed is:

1. An internal combustion engine control apparatus, comprising an electronic control device to which a signal from a knock sensor configured to detect vibration of an internal combustion engine is to be input, the electronic control device being configured to:

apply short-time Fourier transform to an observation signal that is received from the knock sensor to generate an observation matrix; and apply semi-supervised non-negative matrix factorization to a noise basis matrix that is obtained from a reference signal that is received from the knock sensor in a state in which mechanical vibration other than knocking occurs, and to the observation matrix, to thereby decompose the observation matrix into knocking vibration data being data on vibration caused by knocking and mechanical vibration data being data on vibration other than the knocking, wherein the electronic control device includes knock determination circuitry configured to change a knock determination threshold value based on the mechanical vibration data, the knock determination threshold value being a threshold value to be used as a reference in determination of whether excessive knocking occurs.

2. The internal combustion engine control apparatus according to claim 1, wherein the knock determination circuitry is configured to perform determination relating to knocking based on the knocking vibration data, and correct a determination result relating to knocking based on the mechanical vibration data.

3. The internal combustion engine control apparatus according to claim 2, wherein the knock determination circuitry is configured to avoid correcting the determination result under a state in which learning of the noise basis matrix is unfinished.

4. An internal combustion engine control apparatus, comprising an electronic control device to which a signal from a knock sensor configured to detect vibration of an internal combustion engine is to be input, the electronic control device including:

extraction circuitry configured to extract, from the signal from the knock sensor, knocking vibration data being data on vibration caused by knocking and mechanical vibration data being data on vibration other than the knocking; and knock determination circuitry configured to perform determination relating to knocking based on the knocking vibration data, the knock determination circuitry being configured to correct a determination result relating to knocking based on the mechanical vibration data, by applying semi-supervised non-negative matrix factorization to an observation matrix that is obtained from the signal from the knock sensor, and to a noise basis matrix that is retrieved from a memory, and change a knock determination threshold value based on the mechanical vibration data, the knock determination threshold value being a threshold value to be used as a reference in determination of whether excessive knocking occurs.

5. The internal combustion engine control apparatus according to claim 2, wherein the knock determination circuitry is configured to change a knock determination threshold value based on the mechanical vibration data, the knock determination threshold value being a threshold value to be used as a reference in determination of whether excessive knocking occurs.

6. The internal combustion engine control apparatus according to claim 3, wherein the knock determination circuitry is configured to change a knock determination threshold value based on the mechanical vibration data, the knock determination threshold value being a threshold value to be used as a reference in determination of whether excessive knocking occurs.

7. The internal combustion engine control apparatus according to claim 4, wherein the knock determination circuitry is configured to change a knock determination threshold value based on the mechanical vibration data, the knock determination threshold value being a threshold value to be used as a reference in determination of whether excessive knocking occurs.

* * * * *